US009791135B2

(12) United States Patent
Jing

(10) Patent No.: US 9,791,135 B2
(45) Date of Patent: Oct. 17, 2017

(54) AUTOMATIC LAMP REPLACEMENT DEVICE AND ULTRAVIOLET CURING EQUIPMENT

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventor: Yangkun Jing, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 456 days.

(21) Appl. No.: 14/381,763

(22) PCT Filed: Dec. 18, 2013

(86) PCT No.: PCT/CN2013/089807

§ 371 (c)(1),
(2) Date: Aug. 28, 2014

(87) PCT Pub. No.: WO2015/027641

PCT Pub. Date: Mar. 5, 2015

(65) Prior Publication Data

US 2015/0377458 A1 Dec. 31, 2015

(30) Foreign Application Priority Data

Aug. 29, 2013 (CN) ..... 2013 1 0385462

(51) Int. Cl.

| | |
|---|---|
| ***F21V 19/04*** | (2006.01) |
| ***H05B 3/00*** | (2006.01) |
| *H05B 41/02* | (2006.01) |

(52) U.S. Cl.
CPC ..... *F21V 19/04* (2013.01); *H05B 3/0038* (2013.01); *H05B 41/02* (2013.01)

(58) Field of Classification Search
CPC ..... F21V 19/04; H05B 3/0038; H05B 41/02
See application file for complete search history.

(56) References Cited

U.S. PATENT DOCUMENTS 5,980,053 A * 11/1999 Hauser ..... G03B 21/2013 362/20
6,837,410 B1 1/2005 Yeh
2010/0328083 A1* 12/2010 Dillon ..... B05D 3/067 340/600

FOREIGN PATENT DOCUMENTS

CN 200956229 Y 10/2007
CN 201063917 Y 5/2008
(Continued)

OTHER PUBLICATIONS

Office Action issued in Chinese Application No. 201310385462.5 dated Nov. 25, 2014 (Nov. 25, 2014).
(Continued)

*Primary Examiner* — Jun Yoo
(74) *Attorney, Agent, or Firm* — Nath, Goldberg & Meyer; Joshua B. Goldberg

(57) ABSTRACT

The present invention discloses an automatic lamp replacement device and ultraviolet curing equipment, wherein the automatic lamp replacement device comprises: an acquisition unit used for acquiring the luminous intensity information of ultraviolet lamps; a processing unit used for determining that the ultraviolet lamps need to be replaced and generating a control signal when points with values which are less than a set value exist in the luminous intensity information received from the acquisition unit; a control unit used for controlling a carrying device to work according to the control signal received from the processing unit; and the
(Continued)

carrying device used for removing the ultraviolet lamps determined to be the ones needing to be replaced and installing new ultraviolet lamps under the control of the control unit. The automatic lamp replacement device provided by the present invention can improve the automatic control accuracy of the ultraviolet curing equipment.

17 Claims, 2 Drawing Sheets

(56) References Cited

FOREIGN PATENT DOCUMENTS

| | | | | |
|---|---|---|---|---|
| CN | 101350293 | A | 1/2009 | |
| CN | 201620120 | U | 11/2010 | |
| CN | 101976004 | A | 2/2011 | |
| CN | 103128038 | A | 6/2013 | |
| CN | 103152908 | A | 6/2013 | |
| DE | 20011572 | U | 3/2001 | |
| ES | WO 2011029961 | A1 * | 3/2011 | ..... F21V 19/04 |
| JP | 7-323249 | A | 12/1995 | |
| JP | 2010-55911 | A | 3/2010 | |
| KR | 20130026366 | A | 3/2013 | |

OTHER PUBLICATIONS

Search Report issued in International Application No. PCT/CN2013/089807.

* cited by examiner

AUTOMATIC LAMP REPLACEMENT DEVICE AND ULTRAVIOLET CURING EQUIPMENT

This is a National Phase Application filed under 35 U.S.C. 371 as a national stage of PCT/CN2013/089807, filed Dec. 18, 2013, and claims priority benefit from Chinese Application No. 201310385462.5, filed Aug. 29, 2013, the content of each of which is hereby incorporated by reference in its entirety.

FIELD OF THE INVENTION

The present invention relates to the field of a display preparation technology, and in particular relates to an automatic lamp replacement device and ultraviolet curing equipment.

BACKGROUND OF THE INVENTION

During a preparation process of a display, the ultraviolet curing equipment is needed. However, each of the ultraviolet lamps on the ultraviolet curing equipment has a certain service life, and when the service time of the ultraviolet lamp achieves its service life, the ultraviolet lamp need to be replaced in time so as to avoid the occurrence of a poor curing phenomenon.

A method for replacing ultraviolet lamps in the prior art is as follows: when the service time of the ultraviolet lamps achieves 1000 hours, the ultraviolet lamps are replaced, and during the replacement, the lamp boxes of the ultraviolet lamps are manually detached from the curing equipment, and then new ultraviolet lamps are installed on the curing equipment.

However, some ultraviolet lamps can still be continuingly used even when its service time exceeds 1000 hours, thus the method for replacing the ultraviolet lamps according to the service life in the prior art wastes the service time of the ultraviolet lamps; whereas, even when the service time of some ultraviolet lamps is less than 1000 hours, the illuminance of the ultraviolet lamps is already insufficient, and if the method for replacing the ultraviolet lamps according to the service life in the prior art is adopted, poor curing by the curing equipment will be probably caused because the ultraviolet lamps are not replaced in time.

SUMMARY OF THE INVENTION

The present invention provides an automatic lamp replacement device and ultraviolet curing equipment with the automatic lamp replacement device, thus ultraviolet lamps can be automatically replaced to reduce manual operations and the automatic control accuracy of the ultraviolet curing equipment can be improved.

In order to realize the purposes above, the present invention provides the following technical solution:

the present invention provides an automatic lamp replacement device for replacing ultraviolet lamps of ultraviolet curing equipment, the automatic lamp replacement device comprising:

an acquisition unit used for acquiring luminous intensity information of the ultraviolet lamps;

a processing unit connected with the acquisition unit, and used for determining that the ultraviolet lamps need to be replaced and generating a control signal when points with values which are less than a set value exist in the luminous intensity information received by the processing unit from the acquisition unit;

a control unit connected with the processing unit, and used for controlling a carrying device to work according to the control signal received from the processing unit; and the carrying device used for removing the ultraviolet lamps, which are determined to be the ones needing to be replaced, and installing new ultraviolet lamps under the control of the control unit.

The automatic lamp replacement device provided by the present invention is applied to the ultraviolet curing equipment. During the working process of the ultraviolet curing equipment, the acquisition unit is used for acquiring the luminous intensity information of each of the ultraviolet lamps each time when it is working, and transferring the acquired luminous intensity information related to each of the ultraviolet lamps to the processing unit. The processing unit is used for comparing the received luminous intensity information with a pre-stored set value; if points with values which are less than the set value exist in the received luminous intensity information, then the processing unit determines that the ultraviolet lamps corresponding to the points with the values which are less than the set value are the ones needing to be replaced and generates a control signal. Upon receiving the control signal sent from the processing unit, the control unit connected with the processing unit is used for, on one hand, sending a command for controlling the ultraviolet curing equipment to stop working to the ultraviolet curing equipment, on the other hand, controlling the carrying device to start to work, so as to realize removal for the ultraviolet lamps needing to be replaced and installation for the new ultraviolet lamps. Hence, the automatic lamp replacement device provided by the present invention can decide whether the ultraviolet lamps need to be replaced or not according to the detected luminous intensity of the ultraviolet lamps, thus reducing the occurrences of the phenomena of waste of the ultraviolet lamps and insufficient luminous intensity of the ultraviolet lamps, and the automatic lamp replacement device provided by the present invention can control the carrying device to implement lamp replacement, thus reducing excessive manual operations.

Therefore, the automatic lamp replacement device provided by the present invention can improve the automatic control accuracy of the ultraviolet curing equipment.

In some alternative embodiments, the acquisition unit is a luminous intensity sensor arranged in each ultraviolet illumination area of the ultraviolet curing equipment.

In some alternative embodiments, the carrying device comprises:

a support installed on the inner wall of the ultraviolet curing equipment;

a first movement mechanism installed on the support and used for driving the ultraviolet lamps to move along a direction parallel to the length direction of the lamp troughs of the ultraviolet curing equipment;

a second movement mechanism installed on the support and used for driving the first movement mechanism to move in a direction vertical to the plane where the arrangement direction of the lamp troughs of the ultraviolet curing equipment is located; and a third movement mechanism installed on the support and used for driving the second movement mechanism to move along the arrangement direction of the lamp troughs of the ultraviolet curing equipment. The first movement mechanism can remove the ultraviolet lamps needing to be replaced out of the lamp troughs, or move new ultraviolet lamps into the lamp troughs, the second movement mechanism can drive the first movement mechanism and thereby drive the ultraviolet lamps to move in the direction vertical to the plane where the arrangement direction of the lamp troughs of the ultraviolet curing equipment is located, the third movement mechanism can drive the second movement mechanism and thereby drive the ultraviolet lamps to move along the arrangement direction of the lamp troughs, thus move to the positions of the lamp troughs of the ultraviolet lamps needing to be replaced, that is to say, the carrying device can drive the ultraviolet lamps to move in three mutually orthogonal directions X, Y and Z.

In some alternative embodiments, the first movement mechanism comprises:

a first slide block;

an electromagnet attachment device which is arranged on the first slide block and which is, upon being electrified, mutually attracted with a permanent magnet arranged at one end of each of the ultraviolet lamps;

a slide groove extending along a direction parallel to the length direction of the lamp troughs and being in sliding fit with the first slide block; and a first cylinder used for driving the first slide block to slide along the slide groove, the cylinder body of the first cylinder being fixed relative to the slide groove, and the tail end of the piston rod of the first cylinder being fixedly connected with the first slide block. The first slide block is driven to move along the length direction of the lamp troughs of the ultraviolet curing equipment by virtue of the telescopic movement of the first cylinder.

In some alternative embodiments, the second movement mechanism comprises:

two guide rods arranged vertically to the plane where the arrangement direction of the lamp troughs is located, the two guide rods being parallel with each other;

a slide groove arranged on the first slide block and being in sliding fit with the two guide rods; and a first drive device used for driving the first slide block to slide along the guide rods. The first slide block slides along the two guide rods, so as to drive the first movement mechanism to move in a direction vertical to the plane where the arrangement direction of the lamp troughs is located, and thereby drive the ultraviolet lamps to move.

In some alternative embodiments, the first drive device comprises:

a first thread screw arranged to be parallel to the guide rods and being in transmission connection with the first slide block; and a first drive motor fixed relative to the guide rods and being in transmission connection with one end of the first thread screw. The first drive motor rotates and drives the first thread screw to rotate, and thereby drives the first slide block to move along the guide rods.

In some alternative embodiments, the second movement mechanism further comprises: a lifting support table used for supporting the ultraviolet lamps to stably move the ultraviolet lamps along the guide rods. The lifting support table is used for assisting the second movement mechanism to drive the ultraviolet lamps to stably move.

In some alternative embodiments, the lifting support table comprises: a tray used for supporting the ultraviolet lamps, and a second cylinder used for driving the tray to move in the direction vertical to the plane where the arrangement direction of the lamp troughs is located. The tray is fixed relative to the first slide block, the cylinder body of the second cylinder is fixed relative to the support, and the tail end of the piston rod of the second cylinder is fixedly connected with the tray. The descending and ascending speeds of the ultraviolet lamps may be reduced by virtue of the telescoping of the piston rod of the second cylinder, thus the carrying device stably moves as a whole.

In some alternative embodiments, the third movement mechanism comprises:

a guide rail arranged along the arrangement direction of the lamp troughs;

a second slide block being in sliding fit with the guide rail; and a second drive device used for driving the second slide block to slide along the guide rail. The second slide block slides along the guide rail, so as to drive the second movement mechanism to move along the arrangement direction of the lamp troughs, and thereby drive the ultraviolet lamps to move along the arrangement direction of the lamp troughs.

In some alternative embodiments, the second drive device comprises:

a second thread screw arranged to be parallel to the guide rods and in transmission connection with the second slide block; and a second drive motor fixed relative to the guide rail and being in transmission connection with one end of the second thread screw. The second drive motor rotates and drives the second thread screw to rotate, and thereby drives the second slide block to move along the guide rail.

In some alternative embodiments, the carrying device further comprises: a conveying belt used for conveying the ultraviolet lamps out of the ultraviolet curing equipment or into the ultraviolet curing equipment, and a third drive motor used for driving the conveying belt to move.

In some alternative embodiments, the carrying device further comprises:

a rotary disc fixedly connected with the tail ends of the two guide rods, the rotary disc being in transmission connection with the second slide block; and a fourth drive motor used for driving the rotary disc to rotate. Because the interior space of the ultraviolet curing equipment is limited, when the carrying device of the automatic lamp replacement device is arranged in the ultraviolet curing equipment, the specific position of the conveying belt may be arranged according to the interior space of the ultraviolet curing equipment. The ultraviolet lamps may be transferred to the conveying belt by virtue of the rotation of the rotary disc.

The present invention further provides ultraviolet curing equipment, comprising the automatic lamp replacement device of any one of the items above. The automatic lamp replacement device above can not only detect the luminous intensity of the ultraviolet lamps, thus reducing the occurrences of the phenomena of waste of the ultraviolet lamps and insufficient luminous intensity of the ultraviolet lamps, but also control the carrying device to replace the lamps, thus reducing excessive manual operations, therefore, the ultraviolet curing equipment provided by the present invention may improve the automatic control accuracy thereof, and realizing automatic replacement for the ultraviolet lamps.

REFERENCE NUMERALS

1—acquisition unit; 2—processing unit; 3—control unit; 4—carrying device; 41—support; 42—first slide block; 421—electromagnet attachment device; 43—first cylinder; 431—piston rod; 44—guide rod; 45—rotary disc; 46—second cylinder; 47—tray; 5—lamp box

DETAILED DESCRIPTION OF THE EMBODIMENTS

The technical solution in the embodiments of the present invention will be clearly and completely described below in conjunction with the accompanying drawings in the embodiments of the present invention. It becomes apparent that the embodiments described are a part of the embodiments of the present invention only, rather than all of them. Based upon the embodiments in the present invention, all the other embodiments that are obtained by those ordinary skilled in this art without any creative efforts shall still fall within the protection scope of the present invention.

Embodiment I

Figure 1:
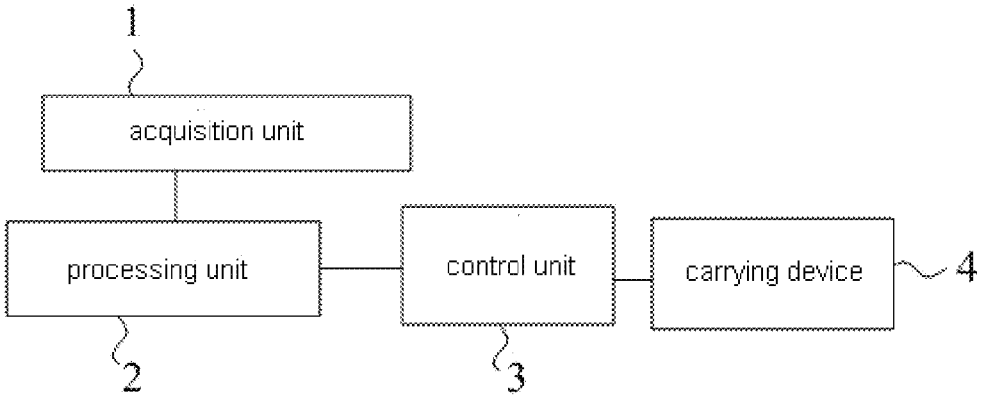
FIG. 1 is a schematic block diagram of an automatic lamp replacement device provided by the present invention for ultraviolet curing equipment.

As shown in FIG. 1, FIG. 1 is a schematic block diagram of an automatic lamp replacement device provided by the present invention for ultraviolet curing equipment, the automatic lamp replacement device provided by the present invention comprising:

an acquisition unit 1 used for acquiring the luminous intensity information of the ultraviolet lamps;

a processing unit 2 connected with the acquisition unit 1 in a wired or wireless manner to execute signal communication, the processing unit 2 being used for determining that the ultraviolet lamps need to be replaced and generating a control signal when points with values which are less than a set value exist in the luminous intensity information received by the processing unit 2 from the acquisition unit 1;

a control unit 3 connected with the processing unit 2 in a wired or wireless manner to execute signal communication, the control unit 3 being used for controlling a carrying device 4 to work according to the control signal received from the processing unit; and the carrying device 4 used for removing the ultraviolet lamps determined to be the ones needing to be replaced and installing new ultraviolet lamps under the control of the control unit 3.

The automatic lamp replacement device provided by the present invention is applied to the ultraviolet curing equipment. During the working process of the ultraviolet curing equipment, the acquisition unit 1 is used for acquiring the luminous intensity information of each of the ultraviolet lamps used each time when it is working, and transferring the acquired luminous intensity information related to each of the ultraviolet lamps to the processing unit 2. The processing unit 2 is used for comparing the received luminous intensity information with a pre-stored set value, and if the points with values which are less than the set value exist in the received luminous intensity information, the processing unit 2 is used for determining the corresponding ultraviolet lamps to be the ones needing to be replaced and generating a control signal. After receiving the control signal sent by the processing unit 2, the control unit 3 connected with the processing unit 2 is used for, on one hand, sending a command controlling the ultraviolet curing equipment to stop working to the ultraviolet curing equipment, on the other hand, controlling the carrying device 4 to start to work, so as to realize removal for the ultraviolet lamps needing to be replaced and installation for the new ultraviolet lamps. Hence, the automatic lamp replacement device provided by the present invention can not only detect the luminous intensity of the ultraviolet lamps, thus reducing the occurrences of the phenomena of waste of the ultraviolet lamps and insufficient luminous intensity of the ultraviolet lamps, but also control the carrying device to replace the lamps, thus reducing excessive manual operations.

Therefore, the automatic lamp replacement device provided by the present invention may improve the automatic control accuracy of the ultraviolet curing equipment.

The luminous intensity information above may be curve luminous intensity information directly, or may be curve information obtained according to the information of a few of points after acquiring the information of the points, or may be the information of a single point.

Further, the acquisition unit 1 may be a luminous intensity sensor arranged in each ultraviolet illumination area of the ultraviolet curing equipment. The luminous intensity sensor can detect the luminous intensity of the ultraviolet lamps, and convey the acquired luminous intensity information to the processing unit 2.

Figure 2:
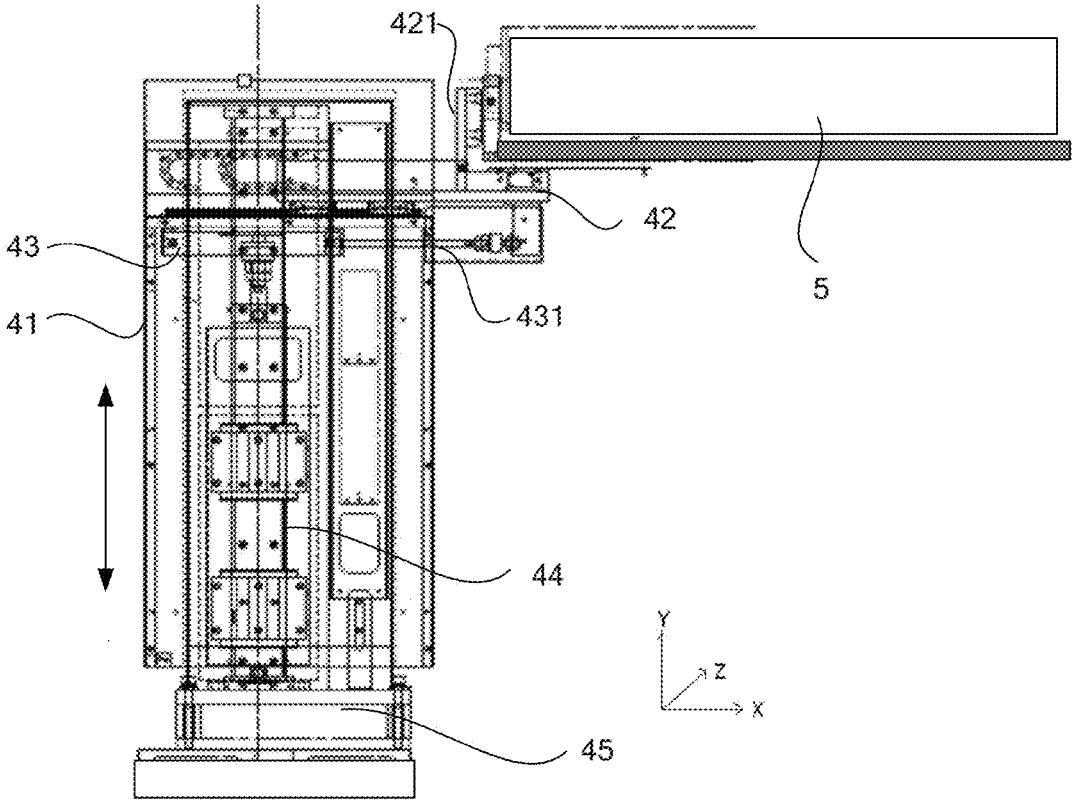
FIG. 2 is a partial structural schematic diagram of a carrying device in the automatic lamp replacement device provided by the present invention.

The carrying device 4 may be in various specific structures, and FIG. 2 shows a preferred embodiment. FIG. 2 is a partial structural schematic diagram of a carrying device in the automatic lamp replacement device provided by the present invention. In this case, the movement direction of each of the movement mechanisms in the figure is described by taking a horizontal direction as an X-axis direction, taking a vertical direction as a Y-axis direction, and taking a direction vertical to a paper surface as a Z-axis direction, and moreover, the lamp troughs of a plurality of ultraviolet lamps are arranged on the ultraviolet curing equipment in the embodiment along the Z-axis direction. However, it should be understood that the description is exemplary only, rather than being intended to limit the present invention. As shown in FIG. 2, the carrying device 4 specifically comprises:

a support 41 installed on the inner wall of the ultraviolet curing equipment;

a first movement mechanism installed on the support 41 and used for driving the lamp boxes 5 of the ultraviolet lamps to move along a direction (along the X-axis direction) parallel to the length direction of the lamp troughs of the ultraviolet curing equipment;

a second movement mechanism installed on the support 41 and used for driving the first movement mechanism to move in a direction (along the Y-axis direction) vertical to the plane where the arrangement direction of the lamp troughs of the ultraviolet curing equipment is located; and a third movement mechanism installed on the support 41 and used for driving the second movement mechanism to move along the arrangement direction (along the Z-axis direction) of the lamp troughs of the ultraviolet curing equipment.

In this case, the first movement mechanism can remove the lamp boxes 5 of the ultraviolet lamps needing to be replaced out of the lamp troughs, or move the lamp boxes 5 of new ultraviolet lamps into the lamp troughs, that is, move to the left or the right along the X-axis direction shown in the figure. The second movement mechanism can drive the first movement mechanism, and thereby drive the lamp boxes 5 of the ultraviolet lamps to move in the direction vertical to the plane where the arrangement direction of the lamp troughs of the ultraviolet curing equipment is located, that is, to move up and down along the Y-axis direction shown in the figure. The third movement mechanism can drives the second movement mechanism, and thereby drive the lamp boxes 5 of the ultraviolet lamps to move along the arrangement direction of the lamp troughs, thus moving to the positions of the lamp troughs of the ultraviolet lamps needing to be replaced, that is, to move along the Z-axis direction shown in the figure. That is to say, the carrying device 4 can drive the lamp boxes to move in three mutually orthogonal directions X, Y and Z.

Specifically, the first movement mechanism comprises:

a first slide block 42;

an electromagnet attachment device 421 arranged on the first slide block 42, and mutually attracted with a permanent magnet arranged at one end of each of the lamp boxes 5 after being electrified;

a slide groove extending along a direction parallel to the length direction of the lamp troughs and being in sliding fit with the first slide block 42; and a first cylinder 43 used for driving the first slide block 42 to slide along the slide groove, the cylinder body of the first cylinder 43 being fixed relative to the slide groove, and the tail end of the piston rod 431 of the first cylinder 43 being fixedly connected with the first slide block 42. The first slide block 42 is driven to move along the length direction of the lamp troughs of the ultraviolet curing equipment, that is, to move along the X-axis direction, by virtue of the telescopic movement of the first cylinder.

The electromagnet attachment device 421 may comprise a support plate, and at least two electromagnet adsorption blocks are arranged on the support plate. Each of the electromagnet adsorption blocks comprises: an iron core, a conductive winding with a power matched with the power of the iron core is wound outside the iron core, and the iron core is magnetized when current flows to the conductive winding. The attraction or repulsion between the electromagnet attachment device 421 and the permanent magnet arranged at one end of each of the lamp boxes 5 is realized according to the different polarities of voltages applied to the electromagnet adsorption blocks. For example, in the embodiment below it is described that the electromagnet attachment device 421 to which a positive voltage is applied attracts the permanent magnet, whereas the electromagnet attachment device 421 to which a negative voltage (or no voltage) is applied repels (or does not attract with) the permanent magnet. However, it should be understood that, the directions of the applied voltages are exemplary only.

In addition, specifically, the second movement mechanism comprises:

two guide rods 44 arranged vertically to the plane where the arrangement direction of the lamp troughs is located, the two guide rods being parallel with each other;

a slide groove arranged on the first slide block 42 and being in sliding fit with the two guide rods 44; and a first drive device used for driving the first slide block 42 to slide along the guide rods 44. The first slide block 42 slides along the two guide rods 44, so as to drive the first movement mechanism to move in a direction vertical to the plane where the arrangement direction of the lamp troughs is located, that is, to move along the Y-axis direction, and thereby drive the lamp boxes to move.

Preferably, the first drive device comprises:

a first thread screw arranged to be parallel to the guide rods 44 and in transmission connection with the first slide block 42; and a first drive motor fixed relative to the guide rods 44 and being in transmission connection with one end of the first thread screw. The first drive motor rotates and drives the first thread screw to rotate, and thereby drives the first slide block 42 to move along the guide rods 44. The forward or reverse rotation of the first thread screw may be driven by controlling the forward or reverse rotation of the first drive motor, thus realizing the ascending or descending of the first slide block 42 along the Y-axis (the direction of arrows shown in FIG. 2).

Because the lamp boxes 5 have gravity themselves, if the lamp boxes 5 are adsorbed simply by the electromagnet attachment device 421 arranged at one side of the first slide block 42, the lamp boxes 5 are liable to incline while moving along the direction of the arrows shown in FIG. 2. In order to prevent the lamp boxes 5 from inclining, and ensure that the second movement mechanism drives the lamp boxes 5 to stably move, the second movement mechanism further comprises: a lifting support table used for supporting the lamp boxes to stably move the lamp boxes along the guide rods. The lifting support table can, on one hand, stably ascend or descend the lamp boxes without inclination, and on the other hand, can adjust the heights of the ultraviolet lamps, so that the luminous intensity irradiated on an object to be cured achieves a preset value, thus prolonging the lives of the ultraviolet lamps and improving the luminous stability and uniformity.

Figure 3:
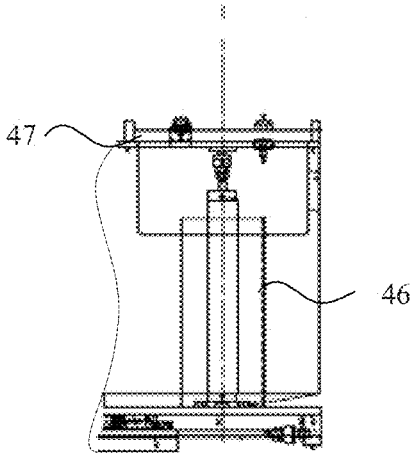
FIG. 3 is a structural schematic diagram of a lifting support table in the carrying device provided by the present invention.

FIG. 3 is a structural schematic diagram of a lifting support table in the carrying device 4 provided by the present invention. As shown in FIG. 3, the lifting support table comprises: a tray 47 used for supporting the ultraviolet lamps, and a second cylinder 46 used for driving the tray 47 to move in the direction vertical to the plane where the arrangement direction of the lamp troughs is located. The tray 47 is fixed relative to the first slide block 42, the cylinder body of the second cylinder 46 is fixed relative to the support 41, and the tail end of the piston rod of the second cylinder 46 is fixedly connected with the tray 47. A buffering effect may be acted on the descending and ascending of the lamp boxes by the telescopic movement of the piston rod of the second cylinder 46, thus the carrying device 4 stably moves as a whole. Of course, the lifting support table may also use other lifting mechanisms such as an elevator lifting mechanism instead of the cylinders for lifting.

In addition, specifically, the third movement mechanism comprises:

a guide rail arranged along the arrangement direction of the lamp troughs;

a second slide block being in sliding fit with the guide rail; and a second drive device used for driving the second slide block to slide along the guide rail. The second slide block slides along the two guide rails, so as to drive the second movement mechanism to move along the arrangement direction of the lamp troughs, and thereby drive the lamp boxes to move along the arrangement direction of the lamp troughs.

Preferably, the second drive device comprises:

a second thread screw arranged to be parallel to the guide rail and in transmission connection with the second slide block; and a second drive motor fixed relative to the guide rail and being in transmission connection with one end of the second thread screw. The second drive motor rotates and drives the second thread screw to rotate, and thereby drives the second slide block to move along the guide rail.

In order to facilitate conveying for the lamp boxes out of the ultraviolet curing equipment, the carrying device 4 above further comprises: a conveying belt used for conveying the ultraviolet lamps out of the ultraviolet curing equipment or into the ultraviolet curing equipment, and a third drive motor used for driving the conveying belt to move. Because the interior space of the ultraviolet curing equipment is limited, when the carrying device 4 of the automatic lamp replacement device is arranged in the ultraviolet curing equipment, the specific position of the conveying belt may be arranged according to the interior space of the ultraviolet curing equipment.

In addition, preferably, the carrying device 4 further comprises:

a rotary disc 45 fixedly connected with the tail ends of the two guide rods 44 and being in transmission connection with the second slide block; and a fourth drive motor used for driving the rotary disc 45 to rotate. The lamp boxes may be transferred to the conveying belt by virtue of the rotation of the rotary disc 45.

To sum up, the automatic lamp replacement device provided by the present invention is used for replacing the ultraviolet lamps on the ultraviolet curing equipment. The automatic lamp replacement device comprises luminous intensity sensors, during the working process of the ultraviolet curing equipment, the luminous intensity sensor arranged in each ultraviolet illumination area of the ultraviolet curing equipment is used for acquiring the luminous intensity information of the ultraviolet lamps used each time when it is working, and transferring the acquired luminous intensity information related to each of the ultraviolet lamps to the processing unit 2. The processing unit 2 is used for comparing the received luminous intensity information with a pre-stored set value; if the points with values which are less than the set value exist in the received luminous intensity information, then the processing unit determines that the ultraviolet lamps corresponding to the points with the values which are less than the set value are the ones needing to be replaced and generates a control signal. After receiving the control signal sent by the processing unit 2, the control unit 3 connected with the processing unit 2 is used for, on one hand, sending a command controlling the ultraviolet curing equipment to stop working to the ultraviolet curing equipment, on the other hand, controlling the carrying device 4 to start to work.

The specific working process of the carrying device 4 is as follows: a positive voltage or a negative voltage is applied on the first drive motor and the second drive motor to drive the rotation of the first thread screw and the second thread screw, thus the first slide block 42 moves to the positions of the lamp troughs of the ultraviolet lamps needing to be replaced along the Y-axis direction and the Z-axis direction. A positive voltage is applied to the electromagnet attachment device 421 arranged at one end of the first slide block 42 to enable the electromagnet attachment device 421 to be mutually attracted with the permanent magnet arranged at one end of each of the old lamp boxes of the ultraviolet lamps needing to be replaced, thus adsorbing the old lamp boxes. The first cylinder 43 shrinks (in an exhaust state) to drive the first slide block 42 to move to the left, and thereby remove the old lamp boxes out of the lamp troughs. A negative voltage or a positive voltage is applied to the first drive motor to move the first slide block 42 downwards along the guide rods 44, and the second cylinder 46 shrinks (in an exhaust state) to drive the tray 47 to support the old lamp boxes to slowly descend. When the old lamp boxes are descended to the tail ends of the guide rods 44, the fourth drive motor is driven according to the arrangement position of the conveying device to drive the rotary disc 45 to rotate a certain angle, thus the old lamp boxes may be placed on the conveying belt, and a negative voltage (or no voltage) is applied to the electromagnet attachment device 421 arranged on the first slide block 42 so that the electromagnet attachment device 421 repels (or does not attract with) the permanent magnet arranged at one end of each of the old lamp boxes, thus realizing separation from the old lamp boxes. The third drive motor is used for driving the conveying belt to move and can convey the old lamp boxes to the corresponding position to be subject to subsequent disposal.

The new lamp boxes of ultraviolet lamps are placed on the conveying belt, and the third drive motor is used for driving the conveying belt to move the new lamp boxes of ultraviolet lamps to the working position of the ultraviolet curing equipment. A positive voltage is applied to the electromagnet attachment device 421 arranged on the first slide block 42 to enable the electromagnet attachment device 421 to be mutually attracted with the permanent magnet arranged at one end of each of the new lamp boxes, thus adsorbing the new lamp boxes. The fourth drive motor is used for driving the rotary disc 45 to rotate again, so as to place the new lamp boxes on the tray 47. A positive voltage or a negative voltage is applied to the first drive motor and the second drive motor, the first drive motor is used for driving the first thread screw to rotate, and thereby driving the first slide block 42 to move upwards along the guide rods 44, and the second cylinder 46 expands (in an intake state) to drive the tray 47 to support the new lamp boxes to slowly ascend. The second drive motor is used for driving the second thread screw to rotate, and thereby driving the second slide block to move upwards along the guide rail (the arrangement direction of the lamp troughs), thus the new lamp boxes are moved to the positions of the corresponding lamp troughs. The first cylinder 43 expands (in an intake state) to drive the new lamp boxes to move towards the lamp troughs. After the new lamp boxes enter the lamp troughs, a negative voltage (or no voltage) is applied to the electromagnet attachment 421 arranged on the first slide block 42 to enable the electromagnet attachment 421 to repel (not to attract with) the permanent magnet arranged at one end of each of the new lamp boxes, thus realizing separation from the new lamp boxes which already enter the lamp troughs. After position sensors induce that the new lamp boxes already enter the lamp troughs, light choppers on the lamp troughs are automatically turned off.

Embodiment II

The embodiment of the present invention provides ultraviolet curing equipment, comprising the automatic lamp replacement device disclosed in embodiment I above. The automatic lamp replacement device above can not only detect the luminous intensity of the ultraviolet lamps, thus reducing the occurrences of the phenomena of waste of the ultraviolet lamps and insufficient luminous intensity of the ultraviolet lamps, but also control the carrying device to replace the lamps, thus reducing excessive manual operations, and improving the automatic control accuracy of the ultraviolet curing equipment. Therefore, the ultraviolet curing equipment provided by the present invention can realize automatic replacement for the ultraviolet lamps.

The ultraviolet lamps in the ultraviolet curing equipment may generate lots of heat during the working process. In order to prevent the heat from reducing the service lives of the ultraviolet lamps, preferably, a heat dissipation device is further arranged on each of the lamp troughs in the ultraviolet curing equipment, and the arranged heat dissipation devices can prolong the lives of the ultraviolet lamps by more than 10%.

Obviously, the person skilled in the art can make various modifications and variations to the present invention without departing from the spirit and scope of the present invention. Thus, if these modifications and variations of the present invention are within the scope of the claims of the present invention and equivalent technologies thereof, the present invention is also intended to include these changes and modifications therein.

The invention claimed is:

1. An automatic lamp replacement device for replacing ultraviolet lamps of ultraviolet curing equipment, comprising:

an acquisition unit used for acquiring luminous intensity information of the ultraviolet lamps;

a processing unit connected with the acquisition unit, and used for determining that the ultraviolet lamps need to he replaced and generating a control signal when points with values which are less than a set value exist in the luminous intensity information received by the processing unit from the acquisition unit;

a control unit connected with the processing unit, and used for controlling a carrying device to work according to the control signal received from the processing unit; and the carrying device used for removing the ultraviolet lamps, which are determined to be the ones needing to be replaced, and installing new ultraviolet lamps under the control of the control unit, wherein the carrying device comprises:

a support installed on the inner wall of the ultraviolet curing equipment;

a first movement mechanism installed on the support and used for driving the ultraviolet lamps to move along a direction parallel to the length direction of lamp troughs of the ultraviolet curing equipment:

a second movement mechanism installed on the support and used for driving the first movement mechanism to move in a direction vertical to the plane where the arrangement direction of the lamp troughs of the ultraviolet curing equipment is located; and third movement mechanism installed on the support and used for driving the second movement mechanism to move along the arrangement direction of the lamp troughs of the ultraviolet curing equipment.

2. The automatic lamp replacement device according to claim 1, wherein the acquisition unit is a luminous intensity sensor arranged in each ultraviolet illumination area of the ultraviolet curing equipment.

3. The automatic lamp replacement device according to claim 1, wherein the first movement mechanism comprises:

a first slide block;

an electromagnet attachment device which is arranged on the first slide block and which is, upon being electrified, mutually attracted with a permanent magnet arranged at one end of each of the ultraviolet lamps;

a slide groove extending along a direction parallel to the length direction of the lamp troughs and being in sliding fit with the first slide block; and a first cylinder used for driving the first slide block to slide along the slide groove, a cylinder body of the first cylinder being fixed relative to the slide groove, and a tail end of piston rod of the first cylinder being fixedly connected with the first slide block.

4. The automatic lamp replacement device according to claim 1, wherein the second movement mechanism comprises:

two guide rods arranged vertically to the plane where the arrangement direction of the lamp troughs is located, the two guide rods being parallel with each other, a slide groove arranged on the first slide block and being in sliding fit with the two guide rods; and a first drive device used for driving the first slide block to slide along the guide rods.

5. The automatic lamp replacement device according to claim 4, wherein the first drive device comprises:

a first thread screw arranged to be parallel to the guide rods and being in transmission connection with the first slide block; and a first drive motor fixed relative to the guide rods and being in transmission connection with one end of the first thread screw.

6. The automatic lamp replacement device according to claim 4, wherein the second movement mechanism further comprises: a lifting support table used for supporting the ultraviolet lamps to stably move the ultraviolet lamps along the guide rods.

7. The automatic lamp replacement device according to claim 6, wherein the lifting support table comprises: a tray used for supporting the ultraviolet lamps, and a second cylinder used for driving the tray to move in the direction vertical to the plane where the arrangement direction of the lamp troughs is located, wherein the tray is fixed relative to the first slide block, a cylinder body of the second cylinder is fixed relative to the support, and a tail end of piston rod of the second cylinder is fixedly connected with the tray.

8. The automatic lamp replacement device according to claim 4, wherein the third movement mechanism comprises:

a guide rail arranged along the arrangement direction of the lamp troughs;

a second slide block being in sliding fit with the guide rail; and a second drive device used for driving the second slide block to slide along the guide rail.

9. The automatic lamp replacement device according to claim 8, wherein the second drive device comprises:

a second thread screw arranged to be parallel to the guide rods and being in transmission connection with the second slide block; and a second drive motor fixed relative to the guide rail and being in transmission connection with one end of the second thread screw.

10. The automatic lamp replacement device according to claim 4, wherein the carrying device further comprises: a conveying belt used for conveying the ultraviolet lamps out of the ultraviolet curing equipment or into the ultraviolet curing equipment, and a third drive motor used for driving the conveying belt to move.

11. The automatic lamp replacement device according to claim 5, wherein the carrying device further comprises: a conveying belt used for conveying the ultraviolet lamps out of the ultraviolet curing equipment or into the ultraviolet curing equipment, and a third drive motor used for driving the conveying belt to move.

12. The automatic lamp replacement device according to claim 6, wherein the carrying device further comprises: a conveying belt used for conveying the ultraviolet lamps out of the ultraviolet curing equipment or into the ultraviolet curing equipment, and a third drive motor used for driving the conveying belt to move.

13. The automatic lamp replacement device according to claim 7, wherein the carrying device further comprises: a conveying belt used for conveying the ultraviolet lamps out of the ultraviolet curing equipment or into the ultraviolet curing equipment, and a third drive motor used for driving the conveying belt to move.

14. The automatic lamp replacement device according to claim 8, wherein the carrying device further comprises: a conveying belt used for conveying the ultraviolet lamps out of the ultraviolet curing equipment or into the ultraviolet curing equipment, and a third drive motor used for driving the conveying belt to move.

15. The automatic lamp replacement device according to claim 9, wherein the carrying device further comprises: a conveying belt used for conveying the ultraviolet lamps out of the ultraviolet curing equipment or into the ultraviolet curing equipment, and a third drive motor used for driving the conveying belt to move.

16. The automatic lamp replacement device according to claim 14, wherein the carrying device further comprises:

a rotary disc fixedly connected with the tail ends of the two guide rods, the rotary disc being in transmission connection with the second slide block; and a fourth drive motor used for driving the rotary disc to rotate.

17. A ultraviolet curing equipment, comprising the automatic lamp replacement device of claim 1.

* * * * *